US005319898A

United States Patent [19]

Freiborg

[11] Patent Number: 5,319,898

[45] **Date of Patent: * Jun. 14, 1994**

[54] ASPHALT COMPOSITION RIDGE COVER

[76] Inventor: Bennie Freiborg, 3936 Madison Rd., Flintridge, Calif.

[ * ] Notice: The portion of the term of this patent subsequent to Mar. 10, 2009 has been disclaimed.

[21] Appl. No.: 848,849

[22] Filed: Mar. 10, 1992

Related U.S. Application Data

[63] Continuation-in-part of Ser. No. 638,781, Jan. 8, 1991, Pat. No. 5,094,042.

[51] Int. Cl.[5] ..... B61D 17/12

[52] U.S. Cl. ..... 52/52; 52/276; 52/748

[58] Field of Search ..... 52/52, 276, 278, 518, 52/526, 528, 558, 559, 741, 748; 156/226, 227, 204

[56] References Cited

U.S. PATENT DOCUMENTS

| | | | |
|---|---|---|---|
| 420,707 | 2/1890 | Toner et al. | 52/276 |
| 1,471,396 | 10/1923 | Griswold | 52/276 |
| 2,192,810 | 3/1940 | Angier | 52/545 |
| 2,305,008 | 12/1942 | Howard | 52/521 |
| 3,913,294 | 10/1975 | Freiborg | 52/518 |
| 4,187,650 | 2/1980 | Poplin | 52/57 |
| 4,226,069 | 10/1980 | Hinds | 52/528 X |
| 4,322,928 | 4/1982 | Freiborg | 52/521 |
| 4,404,783 | 9/1983 | Freiborg | 52/518 |
| 4,434,589 | 3/1984 | Freiborg | 52 X/748 |
| 4,439,955 | 4/1984 | Freiborg | 52/57 |
| 4,580,389 | 4/1986 | Freiborg | 52/747 |
| 4,672,790 | 6/1987 | Freiborg | 52/521 |
| 4,768,318 | 9/1988 | Freiborg | 52/96 |

FOREIGN PATENT DOCUMENTS

| | | | |
|---|---|---|---|
| 506333 | 8/1920 | France | 52/520 |

OTHER PUBLICATIONS

Improvements in Interlocking Roofing Tiles, Wall Sheeting and the like.

*Primary Examiner*—Carl D. Friedman
*Assistant Examiner*—Beth A. Aubrey
*Attorney, Agent, or Firm*—Blakely, Sokoloff, Taylor & Zafman

[57] ABSTRACT

A ridge cover used to shingle houses, that gives a roof the appearance of a wood shake shingle. The cover is constructed from a rectangular sheet of asphalt composition which has a plurality of folding tabs. The tabs are arranged such that when the tabs are folded from the side, the resulting cover has a thickened portion on one end of the cover.

29 Claims, 5 Drawing Sheets

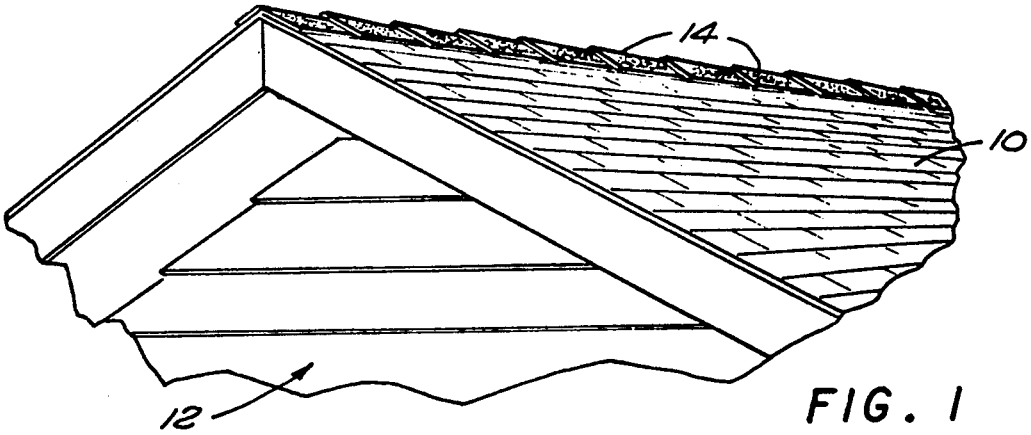
FIG. 1
FIG. 3
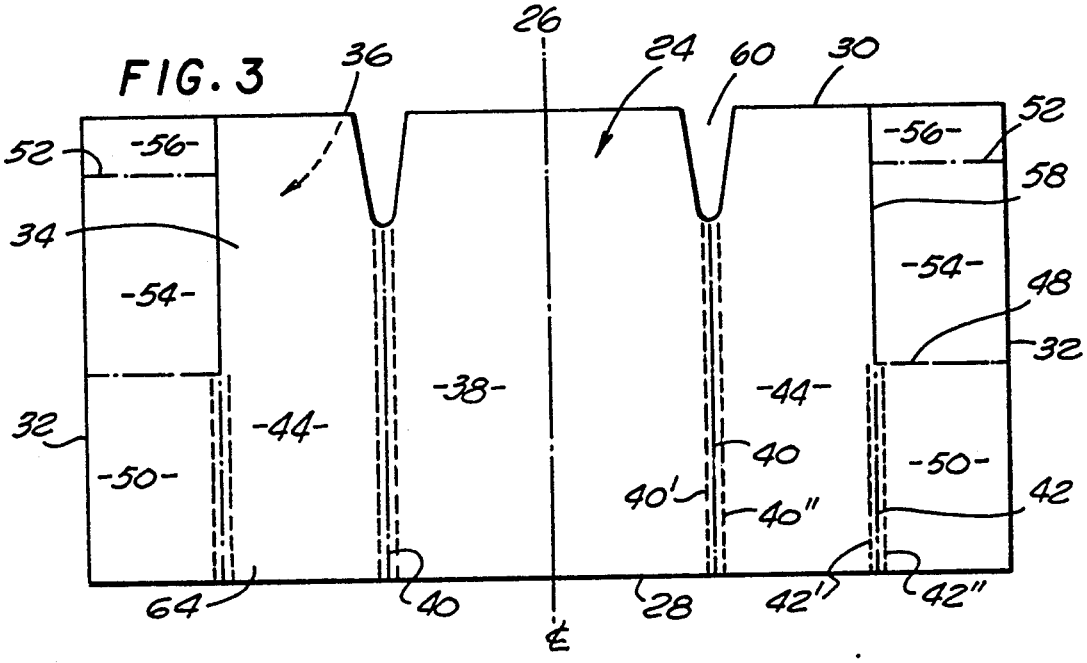
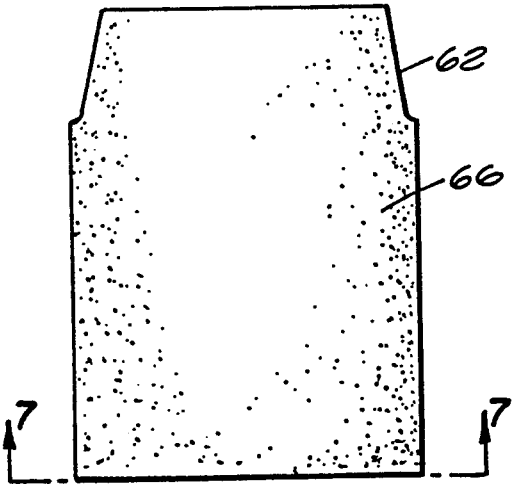
FIG. 5
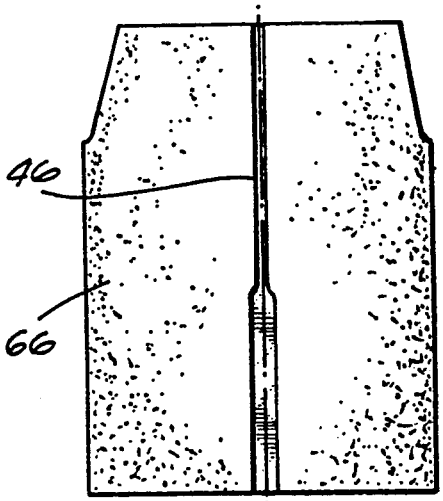
FIG. 4

FIG. 6
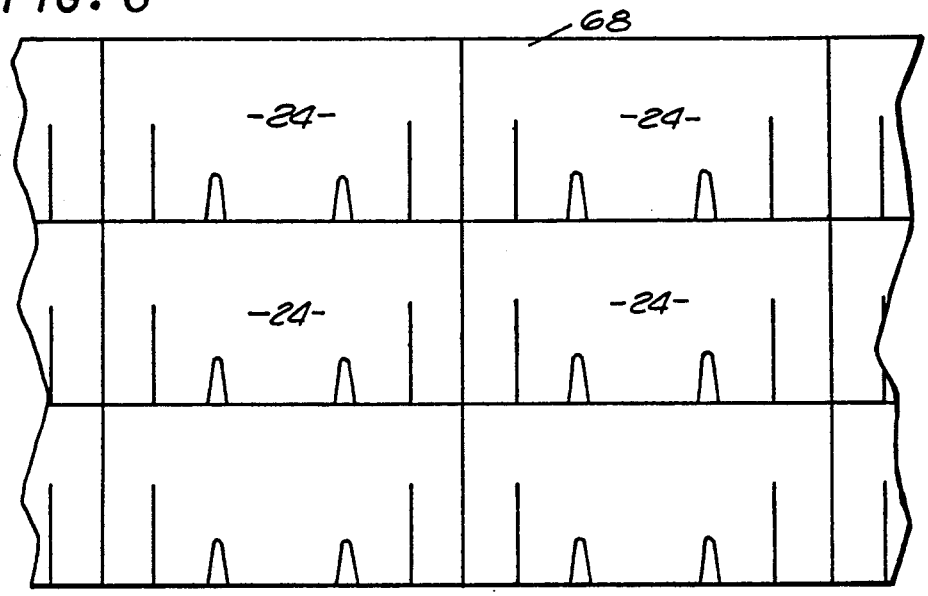
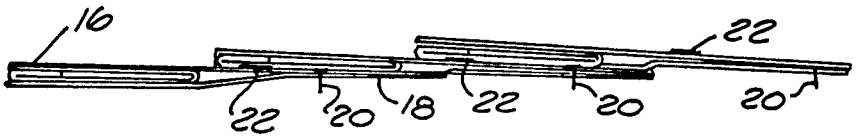
FIG. 2
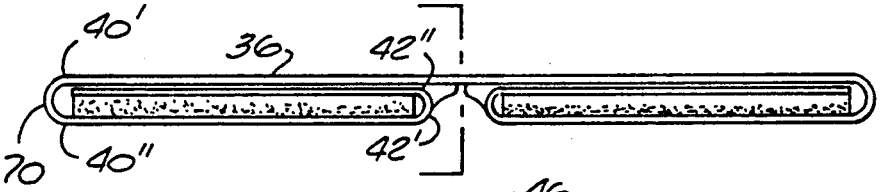
FIG. 7
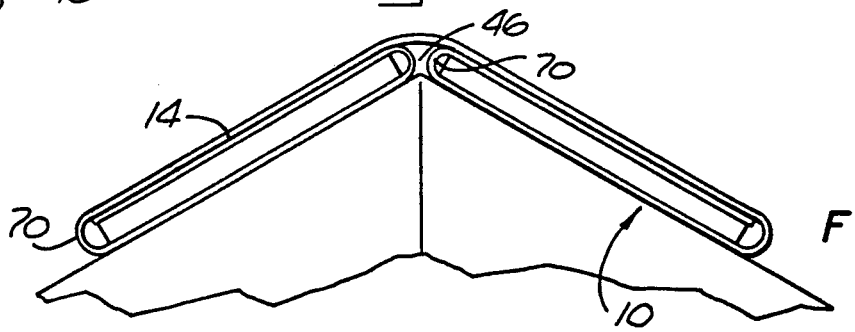
FIG. 8
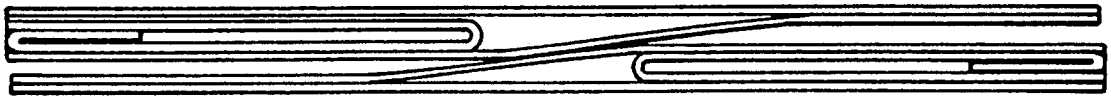
FIG. 9

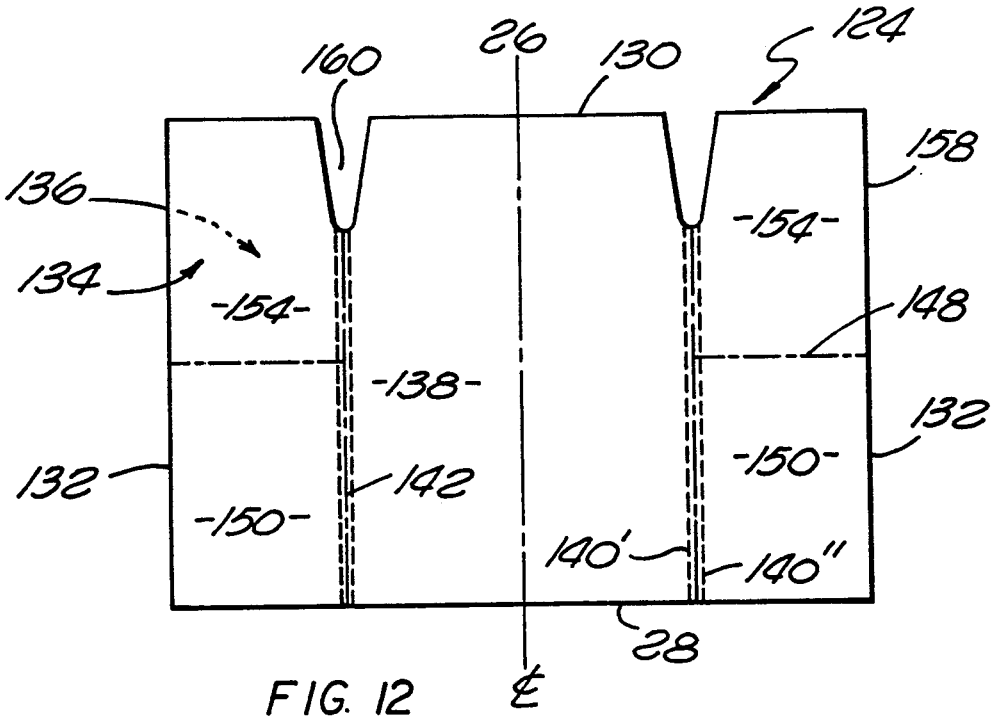
FIG. 12
FIG. 13B
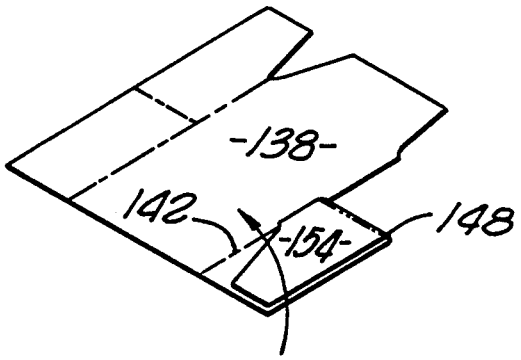
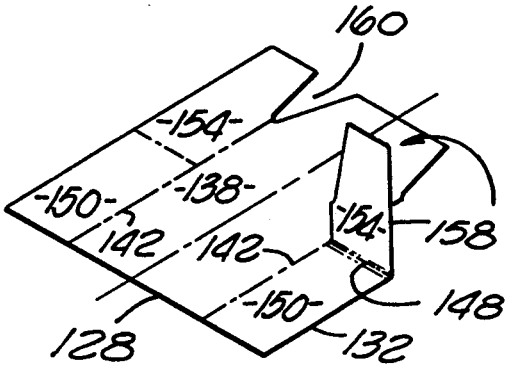
FIG. 13A
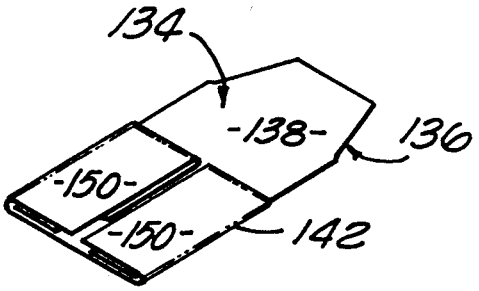
FIG. 13D
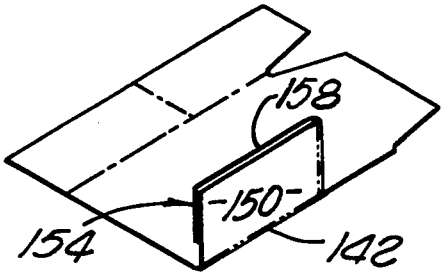
FIG. 13C

ASPHALT COMPOSITION RIDGE COVER

This application is a continuation-in part of application Ser. No. 638,781 filed on Jan. 8, 1991, now U.S. Pat. No. 5,094,092.

FIELD OF INVENTION

This invention relates to asphalt composition ridge covers that are typically attached to the roofs of residential buildings.

BACKGROUND OF THE INVENTION

Ridge covers are used to shingle the ridge of a roof. It has become increasing popular to shingle the roof ridge, such that it has the appearance of a shake shingle roof. The present inventor had devised a ridge cover, described in U.S. Pat. No. 4,434,589, with a varying thickness that when installed, produced the shake shingle effect. The change in thickness was created by taking a single flat piece of asphalt composition and folding multiple tabs until the desired thickness was obtained. As shown in FIG. 5 of the '589 patent, the individual pieces were cut out from a roll of asphalt composition into the desired shapes. The cutting of these irregular shaped pieces produced an excess amount of waste asphalt material, that is both costly and difficult to dispose.

U.S. Pat. No. 3,913,294 by the same inventor, discloses a ridge cover with a thickened portion that is formed by folding the middle portion of the cover. The '294 covers have to be packed in corrugated boxes which are bulky and costly. The covers can not be stacked on pallets because adjacent covers are supported by the thickened middle portion, wherein the thin portions tend to bend or bow. Therefore what is needed is a ridge cover of varying thickness that can be efficiently stacked and cut from a roll with minimal waste.

SUMMARY OF INVENTION

The present invention is a ridge cover constructed from a rectangular sheet of asphalt composition which has a plurality of folding tabs. The tabs are arranged such that when the tabs are folded from the side, the resulting cover has a thickened portion on one end of the cover. Because the covers are rectangular and thicker at one end, the covers can be stacked by rotating each adjacent cover 180 degrees, such that the thick portion of one cover is contiguous to the thin portion of an adjacent cover. The rectangular shape of the unfolded asphalt sheet allows individual sheets to be cut from a roll with minimal waste.

Therefore it is an object of this invention to provide a ridge cover of varying thickness that produces little waste when cut from a roll.

It is also an object of this invention to provide a ridge cover of varying thickness that can be easily stacked and shipped.

BRIEF DESCRIPTION OF THE DRAWINGS

The objects and advantages of this invention will become more apparent to those skilled in the art after reviewing the following detailed description and drawings, wherein:

FIG. 1 is a perspective view of a portion of a house, with the ridge covers of the present invention installed on the ridge of the house;

FIG. 2 is a side view of a roof, showing the ridge covers attached to the house in overlapping fashion;

FIG. 3 is a bottom view of a single sheet of asphalt composition;

FIG. 4 is a bottom view of a folded ridge cover;

FIG. 5 is a top view of FIG. 4;

FIG. 6 is a top view of a roll of asphalt composition showing the cutting lines of each individual sheet;

FIG. 7 is a front view of FIG. 5, taken at line 7—7;

FIG. 8 is a front view of a bent ridge cover attached to the roof of a house;

FIG. 9 is a cross-sectional side view, showing two folded ridge covers stacked on top of each other;

FIG. 12 is a bottom view similar to FIG. 3, showing an alternate embodiment of the present invention;

FIG. 13*a* shows the first fold being made to the ridge cover of FIG. 12;

FIG. 13*b* shows the first fold completed;

FIG. 13*c* shows the ridge cover going through the final fold;

FIG. 13*d* shows the final fold completed;

DETAILED DESCRIPTION OF THE INVENTION

Figure 10A:
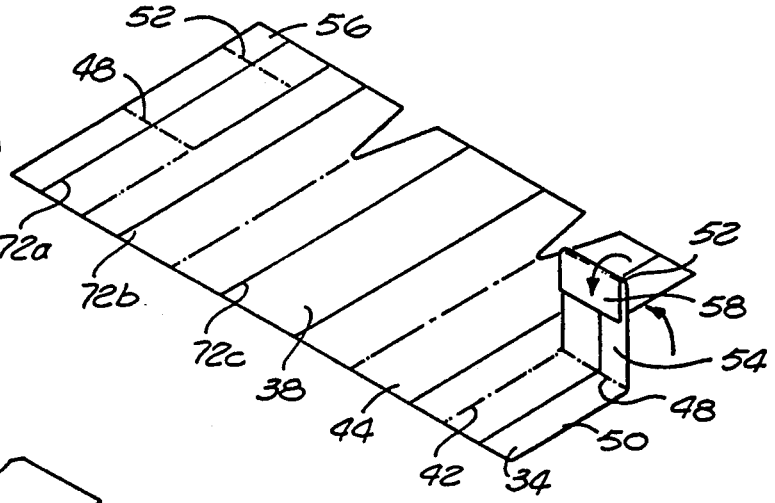
FIG. 10*a* shows the first fold made to the ridge cover.
Figure 10B:
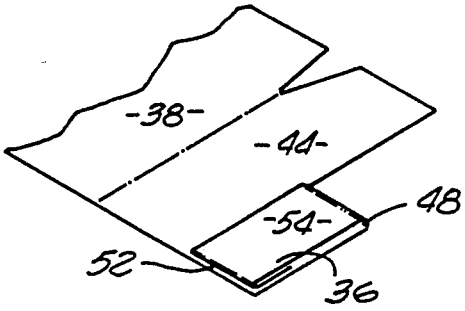
FIG. 10*b* shows the second fold made to the ridge cover.

Referring to the drawings more particularly by reference numbers, number 10 in FIG. 1 is the roof 10 of a house 12, with a plurality of ridge covers 14 installed on the ridge of the house 12. It is to be understood that the phrase ridge cover, as used herein, is used in the broad sense to include hip covers and the like, and is used merely as a convenient phrase for identifying all such covers 14. FIG. 2 more clearly shows the installation of the covers 14. When installed the thickened portion 16 of the covers 14 are placed over the back portion 18 of the adjacent cover, so as to conceal the nails 20 used to attach the covers 14 to the roof 10. The resulting structure creates an appearance similar to a wood shake shingle roof. The folded covers 14 are typically 12" long and 9" wide. An adhesive strip 22 may be applied to the cover on the back portion 18, to attach the thickened portion 16 of the overlaying cover 14 with the back portion 18 of the underlying cover 14.

FIG. 3 shows the preferred embodiment of an unfolded ridge cover 14. The ridge cover 14 starts from a single sheet 24 of asphalt composition that is rectangular in shape and has a centerline 26 along the width of the sheet 24. The sheet 24 has a first end 28, a second end 30, a pair of edges 32, a first face 34 and a second face 36. The sheet 24 has a center portion 38 defined as the area between a pair of first fold lines 40. Between the first fold lines 40 and a pair of second fold line 42 are a pair of first edge tabs 44. The distance between the first 40 and second 42 fold lines is slightly less than the distance from the centerline 26 to one of the first fold lines 30. When the first edge tabs 44 are folded over, the end of the first edge tabs 44 (the second fold lines 42) do not reach the centerline. As shown in FIG. 4, this creates a breakgap 46 that allows the ridge cover 14 to be bent more easily onto the roof. Between the second fold lines 42 and the sheet edges 30, and between the first end 28 and a pair of third fold lines 48 are a pair of second edge tabs 50. From the third fold lines 48 and a pair of fourth fold lines 52 is a pair of third edge tabs 54. Extending from the fourth fold lines to the second end 30 are a pair of fourth edge tabs 56. The length of the third edge tabs 54 should be such that when the third edge tabs are folded onto the second edge tabs 50 the end of the third edge tabs defined by line 52, does not exceed the first end 28. Thus, when the sheet 24 is folded, the folded tabs 54 and 56 do not stick out of the cover 14. To facilitate folding the third and fourth edge tabs onto the second edge tabs 50, a pair of slits 58 are cut from the second end 30 to the third fold lines 48, along the second fold lines 42. A pair of notches 60 are cut into the sheet 24 from the second end 30 along the first fold lines 40. When the cover 14 is folded, the notches 60 create a taper 62 on the back end 18, as shown in FIG. 5. The taper 62 is produced so that when the covers 14 are installed the back end 18 does not stick out from under the thickened portion 16 of the overlapping cover.

The sheet 24 typically comprises a layer of asphalt saturated felt 64, which has a layer of rock granules 66 applied to the second face, wherein the rock granules 66 form the outer surface of the folded cover 14 as shown in FIGS. 4 and 5. The individual sheets 24 are initially part of a roll 68 a portion of which is shown in FIG. 5. The roll 68 is cut into rectangular sheets 24. In addition, the slits 58 are cut and the notches 60 punched out to produce the desired form. The rectangular shape eliminates the waste that is produced with other forms such as the cover disclosed in '589. This is important for large production runs, wherein even the smallest pieces of excess material can cumulate into large amounts of costly scrap and hard to dispose waste.

The fold lines are formed by passing the still hot asphalt felt under rollers (not shown) that depress the felt 64. It has been found that when the cover 14 is folded, the layer of granules 66 and felt 64 tend to split, crack and separate. As a result, the visible edges formed by these folds appear ragged and broken. To reduce the occurrence of this defect, a relief radius 70 can be formed in the folded cover 14, see FIG. 7, by replacing the first 40 fold lines with a pair of spaced apart first fold lines indicated in FIG. 3 as 40' and 40''. The second fold line 42 may also be replaced with a pair of spaced apart second fold lines 42' and 42''. The fold about the pair of second fold lines 42' and 42'' can be seen in FIG. 4, with the increased breakgap 46 toward the first end 28. As stated earlier, the breakgap 46 allows the cover 14 to be bent and installed onto the roof 60 as shown in FIG. 8.

FIG. 9 shows one of the more attractive features of the present invention, the ability to efficiently stack the covers 14 for packing and shipping. By constructing the ridge covers 14 with a thickened portion 16 at the first end 28, the covers 14 can be stacked on top of each other by rotating each cover 14 180 degrees as shown in FIG. 9. This arrangement not only maximizes space, but also prevents the covers from bending or bowing during shipping, where temperatures can exceed the softening temperature (approximately 90 F.) of the asphalt felt 64. The cover 14 can then be stacked on pallets and easily transported to a job site.

Figure 10C:
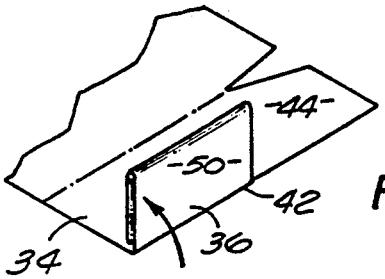
FIG. 10*c* shows the ridge cover going through the third fold.
Figure 10D:
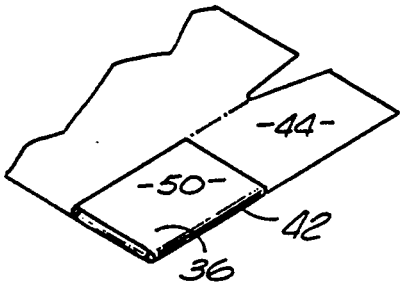
FIG. 10*d* shows the third fold made to the ridge cover.
Figure 10E:
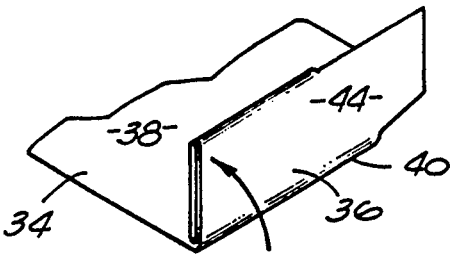
FIG. 10*e* shows the ridge cover going through the final fold.
Figure 10F:
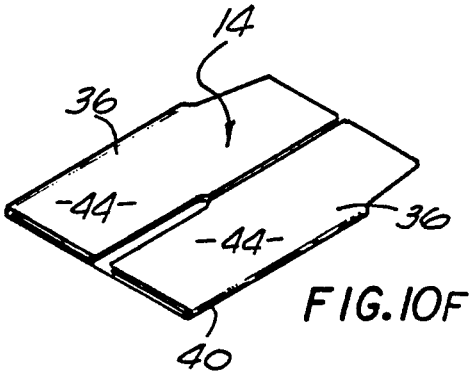
FIG. 10*f* shows the final fold made to the ridge cover.

FIGS. 10*a–f* show how the sheet 24 is folded into a ridge cover 14. First, the fourth edge tabs 56 are folded about the fourth fold line 52, wherein the first face 34 of the fourth edge tabs 56 faces the first face 34 of the third edge tab 54. The folded fourth edge tabs 56 and third edge tabs 54 are then folded about the third fold lines 48, such that the second face 36 of the fourth edge tabs 56 and first face 34 of the third edge tabs 54 faces the first face 34 of the second edge tabs 50. The second edge tabs 50 and folded third edge tabs 54 are then folded about the second fold lines 42 onto the first edge tabs 44 as shown in FIGS. 10*c–d*. In this position, the second face 36 of the third edge tab 54 faces the first face 34 of the first edge tabs 44. In the final step, the first edge tabs 44 and folded second edge tabs 50 are folded about the first fold line 40 onto the center portion 38, wherein the second face 36 of the second edge tabs 50 and the first face 34 of the first edge tabs 44, faces the first face 34 of the center portion 38.

In the preferred embodiment beads of adhesive 72 are applied to the first face 34 as shown in FIG. 10*a*. The adhesive 72 act as a means of attaching the faces of the tabs that face each other as described hereinafter. The first face 34 of the fourth edge tabs 56 are attached to said first face 34 of the third edge tabs 54, and the second face 36 of the fourth edge tabs 58 and first face 34 of the third edge tabs 54 are attached to the first face 34 of the second edge tabs 50, by a first pair of adhesive lines 72*a* running essentially parallel with the second fold line 42, approximately at the center of the second 50, third 54 and fourth 58 edge tabs. The second face 36 of the third edge tabs 54 are attached to the first face 34 of the first edge tabs 44 by a second pair of adhesive lines 72*b* running essentially parallel with the first fold line 40, approximately at the center of the first edge tabs 44. The second face 36 of the second edge tabs 44 and the first face 34 of the first edge tabs 44 are attached to the first face 34 of the center portion 38 by a third pair of adhesive lines 72*c*, running essentially parallel with the centerline 26 approximately one-half the distance between the centerline 26 and said first fold line 40. The adhesive 72 insures that the folded tabs don't "spring" back to the flat position.

Figure 11:
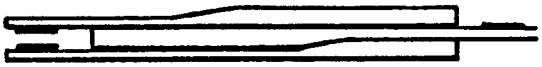
FIG. 11 is a side view of an alternate mode of stacking ridge covers having a tacking adhesive.

When the back adhesive strip 22 is added to the cover to facilitate installation, an alternate method of stacking the cover 14 can be performed as shown in FIG. 11.

As alternate embodiments, the fourth 56, or the third 54 and fourth 56 edge tabs could be eliminated. If the third 54 and fourth 56 edge tabs are eliminated, the first edge tabs 44 could end at the third fold line 48, wherein the thickened portion 16 is formed by folding the second 50 and first 44 edge tabs.

FIG. 12 shows another alternate embodiment of the present invention. The ridge cover is constructed from a sheet 124 that is similar to the sheet 24 shown in FIG. 3, except that the first edge tabs 44 are not formed therein. The removal of the first edge tabs 44 simplifies the folding of the sheet, by eliminating one of the folds. Because there are less folds, the sheet 124 creates a ridge cover that is thinner than a ridge cover produced from the sheet 24 of FIG. 3. Although FIG. 12 shows the third edge tabs 154 extending to the second end 130, it is to be understood that a fourth edge tab could be incorporated therein, as shown in FIG. 3. The addition of a fourth edge tab would increase the overall thickness of the folded ridge cover.

FIGS. 13*a–d* show how the sheet 124 is folded into a ridge cover. First, a third edge tab 154 is folded about a third fold line 148, such that the first face 134 of the third edge tab 154 faces the first face 134 of the second edge tab 150. The second edge tab 150 and folded third edge tab 154 are then folded about the second fold line 142 onto the center portion 138, wherein the second face 136 of the third edge tab 150 faces the first face 134 of the center portion 138. The process is repeated with the other edge tabs to create the ridge cover shown in FIG. 13*d*.

The cover 114 can then be bent about the centerline 126 for installment onto the ridge of a house. Adhesive can be applied to the cover 114 to further secure the tabs as described above. Although notches 160 are shown incorporated into the sheet 124, it is to be understood that a ridge cover 114 can be constructed from a sheet without notches 160. Such an embodiment would eliminate material waste in the cutting of the sheets 124 from the roll 68 shown in FIG. 6.

Figure 14:
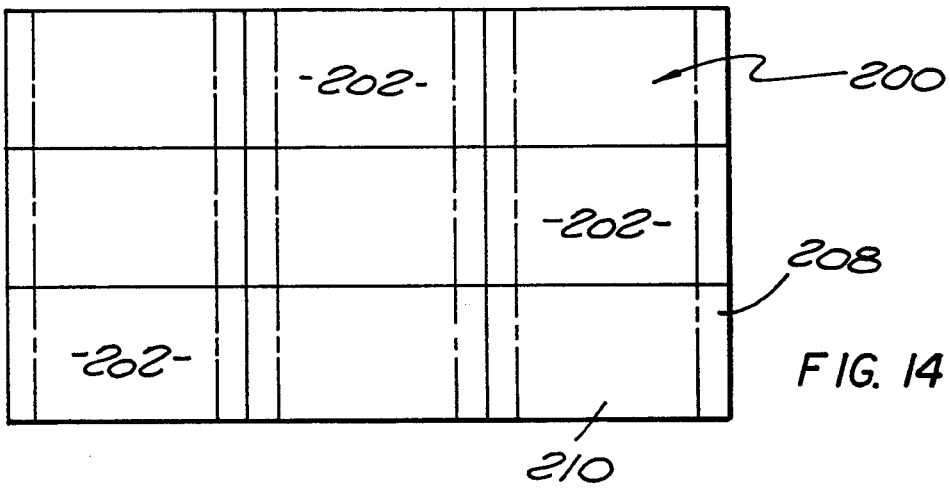
FIG. 14 is a top view of a roll of asphalt composition cut into a plurality of sheets.
Figure 15:
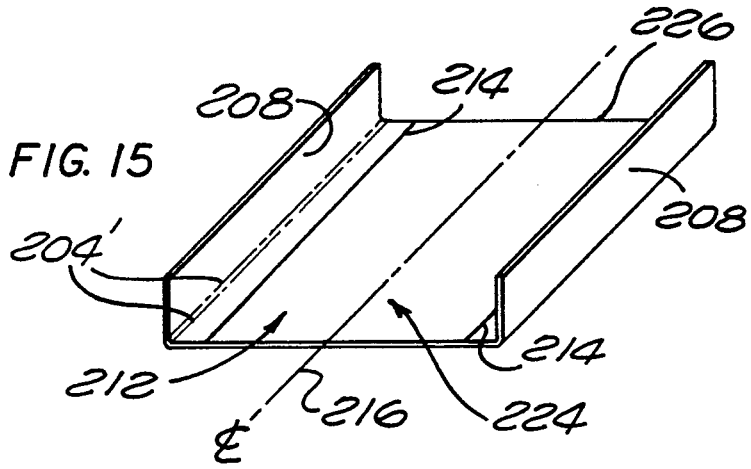
FIG. 15 is a perspective view showing a sheet from FIG. 14 being folded into a ridge cover.

FIGS. 14 and 15 show the construction of another embodiment of the ridge cover. Rolls 200 of asphalt saturated felt are layed out and cut into individual sheets 202. The sheets 202 may be cut manually, or automatically with use of a conveyor belt (not shown) and blades or saws (not shown). Saws may be placed in front of the roll 200 and cut along the longitudinal axis of the asphalt felt, as the same is travelling along a conveyor. Another saw or saws may periodically engage the felt and cut along the width of the roll 200. In the preferred embodiment, the roll is approximately 36 inches wide and cut into sheets 18 inches long by 12 inches wide. The sheets 202 are cut into rectangular shapes without any notches, etc., so that there is essentially no waste in the construction of the ridge cover.

Fold lines 204 are formed in the sheets 202, preferably before cutting, by passing the still hot asphalt under rollers that depress the felt. The fold lines 204 are preferably 3 inches from the edges 206 of the sheet. The fold lines 204 define a pair of edge tabs 208 and a center portion 210 of each sheet 202. Each edge tab 208 is folded about the fold lines 204, so that the first faces 212 of the edge tabs 208 face the first face 212 of the center portion 210. Adhesive lines 214 may be added to secure the edge tabs 208 to the center portion 210. To reduce the stress of the folded corners, each fold line 204 may be replaced with a pair of fold lines 204'.

After the edge tabs 208 are folded, the sheet 202 can be folded about the centerline 216, stacked and shipped. In the alternative, the folded sheets can be shipped without folding about the centerline 216, wherein the centerline fold is performed at the job site. It is preferable to make the centerline fold before shipping, so that the temperature of the sheet can be controlled during the fold. If the fold is done at the job site, the temperature may be quite low, wherein the asphalt felt material will have a greater tendency to crack when folded.

Figure 16:
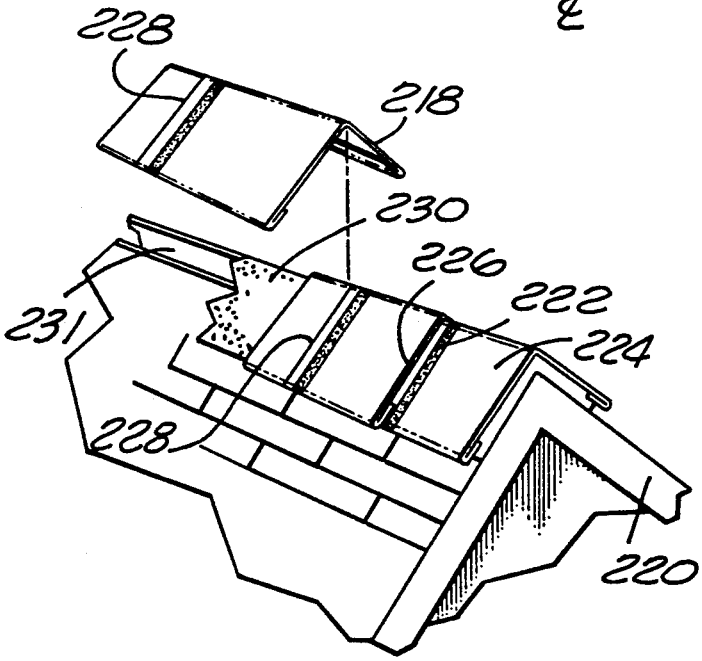
FIG. 16 is a perspective view showing ridge covers being assembled onto the ridge of a house.

As shown in FIG. 16, the ridge covers 218 are attached to the ridge 220 of a house. The covers 218 may have a darkened area 222 that extends across the second face 224 of the sheet. Each cover 218 is placed on top of the underlying cover, so that the end 226 of the cover is adjacent to the darkened area 222, leaving the darkened area 222 exposed. The darkened area 222 gives the appearance that the ridge cover 218 is thicker than it really is. It is to be understood that the darkened area may also be incorporated into the ridge covers 14 and 114, discussed above.

The ridge covers 218 are typically nailed to the ridge 220. To further secure the covers, a second strip of adhesive 228 may extend across the second face 224 of each sheet 202. The adhesive attaches the underside of the overlaying cover to the second face 224 of the underlying cover. To facilitate packing and shipping, a removable protective strip may cover the adhesive. The protective strip is then removed when the covers are assembled onto the ridge.

In the preferred embodiment, a strip of porous material 230 is initially attached to the top of the ridge. The porous material 230 is preferably constructed as a fiber mat that provides optimum air flow therethrough. The covers 218 are then attached to the porous material 230 and the ridge 220. The top of the ridge 220 has slots 231 that allow air to flow from the interior of the structure (typically an attic) to the ambient. The slots 231 are typically cut into the roof after the roof sheathing has been attached to the trusses. Such an assembly allows air to circulate through the roof, preventing air from becoming trapped in the attic and causing damage to the building.

Figure 17:
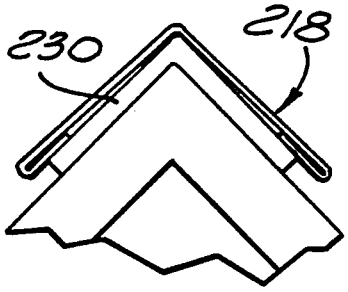
FIG. 17 is a side view of a ridge cover separated from the ridge of a roof by a porous sheet.

As shown in FIG. 17, the cover 218 is typically wider than the porous material 230, so that there is an overhang between the two members. The overhang prevents water and other material from falling onto the porous material and flowing into the building. The folded edge tabs 208, structurally reinforce the edges of the assembled covers 218, to reduce cracking and other damage to the covers, due to wind, rain or any other force that may stress the same. To this end, the overhang of the cover is preferably less than the width of the edge tab, so that a portion of the folded edge is supported by the porous material 230. This prevents the creation of a localized stress line in the cover, which would occur if the reduction in cover thickness was located in the overhang portion of the assembly. Although a cover with edge tabs 208 that are narrower than the center portion 210 is shown, it is to be understood that the edge tabs 208 could be wider, such that the folded tabs 208 extend to the centerline 216 of the sheet 202.

While certain exemplary embodiments have been described above and shown in the accompanying drawings, it is to be understood that the embodiments are merely illustrative of, and not restrictive on the broad invention. It also being understood that this invention should not be limited to the specific constructions and arrangements shown and described, since various other modifications may occur to persons having ordinary skill in the art.

What is claimed is:

1. An asphalt composition ridge cover having a centerline, comprising:

an essentially rectangular sheet having a first end, a second end, a pair of edges, a first face and a second face each said end and said edge extending along a straight line such that said edges and said ends define a parallelogram;

a pair of fold locating means in said sheet that define a center portion, said fold locating means extending essentially parallel to the centerline; and, a pair of edge tabs defined by that portion of said sheet between said fold locating means and said sheet edges.

2. The asphalt composition ridge cover as recited in claim 1, wherein each said fold locating means comprises a crease in said sheet.

3. The asphalt composition ridge cover as recited in claim 2, wherein each said fold locating means comprises a pair of spaced apart creases.

4. The asphalt composition ridge cover as recited in claim 1, wherein said sheet has a darkened area extending across said second face of said sheet.

5. A method of forming an asphalt composition ridge cover having a centerline, comprising the steps of:

a) providing;

an essentially rectangular sheet having a first end, a second end, a pair of edges, a first face and a second face each said end and said edge extending along a straight line such that said edges and said ends define a parallelogram;

a pair of fold locating means in said sheet that define a center portion, said fold locating means extending essentially parallel to the centerline;

a pair of edge tabs defined by that portion of said sheet between said fold locating means and said sheet edges; and, b) folding said pair of edge tabs about said pair of fold locating means, such that said first faces of said edge tabs are facing said first face of said center portion.

6. The method as recited in claim 5, wherein said first faces of said edge tabs are attached to said first face of said center portion.

7. The method as recited in claim 6, wherein said first faces of said edge tabs are attached to said first face of said center portion by a pair of adhesive lines running essentially parallel with the centerline approximately three-fourths the distance from the centerline to said locating means.

8. An asphalt composition ridge cover having a centerline, comprising:

an essentially rectangular sheet having a first end, a second end, a pair of edges, a first face and a second face each said end and said edge extending along a straight line such that said edges and said ends define a parallelogram;

a pair of first fold locating means in said sheet that define a center portion, said first fold locating means extending essentially parallel to the centerline;

a pair of first edge tabs defined by that portion of said sheet between said first fold locating means and said sheet edges, said pair of first edge tabs extending from said first end to a pair of third fold locating means; and, a pair of second edge tabs defined by that portion of said sheet between said pair of first fold locating means and said sheet edges, and between said pair of second fold locating means and said second end.

9. The asphalt composition ridge cover as recited in claim 8, wherein each said fold locating means comprises a crease in said sheet.

10. The asphalt composition ridge cover as recited in claim 9, wherein each said first fold locating means comprises a pair of spaced apart creases.

11. The asphalt composition ridge cover as recited in claim 8, further comprising a pair of notches extending from said second end along said pair of first locating means.

12. The asphalt composition ridge cover as recited in claim 8, further comprising a pair of slits extending from said second end along said pair of first fold locating means, said slits separate said second edge tabs from said center portion.

13. The asphalt composition ridge cover as recited in claim 8, further comprising a pair of third edge tabs defined by that portion of said sheet between said pair of first fold locating means and said sheet edges, and between a pair of third fold locating means and said second end.

14. The asphalt composition ridge cover as recited in claim 13, wherein said third fold locating means comprises a crease in said sheet.

15. The asphalt composition ridge cover as recited in claim 13, further comprising a pair of slits extending from said second end along said pair of first fold locating means, said slits separate said second edge tabs and said third edge tabs from said center portion.

16. The asphalt composition ridge cover as recited in claim 15, further comprising a pair of notches extending from said second end along said pair of first locating means.

17. The asphalt composition ridge cover as recited in claim 8, wherein said sheet has a darkened area extending across said second face of said sheet.

18. A method of forming an asphalt composition ridge cover having a centerline, comprising the steps of:

a) providing;

an essentially rectangular sheet having a first end, a second end, a pair of edges, a first face and a second face each said end and said edge extending along a straight line such that said edges and said ends define a parallelogram;

a pair of first fold locating means in said sheet that define a center portion, said first fold locating means extending essentially parallel to the centerline;

a pair of first edge tabs defined by that portion of said sheet between said first fold locating means and said sheet edges, said pair of first edge tabs extending from said first end to a pair of second fold locating means;

a pair of second edge tabs defined by that portion of said sheet between said pair of first fold locating means and said sheet edges, and between said pair of second fold locating means and said second end;

b) folding said pair of second edge tabs about said pair of second fold locating means, such that said first faces of said second edge tabs are facing said first faces of said first edge tabs;

c) folding said folded pair of second edge tabs and said pair of first edge tabs about said pair of first fold locating means, such that said second faces of said second edge tabs are facing said first face of said center portion.

19. The method as recited in claim 18, wherein said first faces of said second edge tabs are attached to said first faces of said first edge tabs, and said second faces of said second edge tabs are attached to said first face of said center portion.

20. The method as recited in claim 19, wherein said first faces of said second edge tabs are attached to said first faces of said first edge tabs by a pair of adhesive lines running essentially parallel with said first fold locating means approximately at the center of said second and second edge tabs, said second faces of said second third edge tabs are attached to said first face of said center portion by a pair of adhesive lines running essentially parallel with the centerline approximately one-half the distance between the centerline and said first locating means.

21. The method as recited in claim 18, wherein said sheet has a pair of notches extending from said second end along said pair of first fold locating means.

22. The method as recited in claim 18, wherein said sheet has a pair of slits extending from said second end along said pair of first second fold locating means, said slits separate said second edge tabs from said center portion.

23. A method of forming an asphalt composition ridge cover having a centerline, comprising the steps of:

a) providing;

an essentially rectangular sheet having a first end, a second end, a pair of edges, a first face and a second face each said end and said edge extending along a straight line such that said edges and said ends define a parallelogram;

a pair of first fold locating means in said sheet that define a center portion, said first fold locating means extending essentially parallel to the centerline;

a pair of first edge tabs defined by that portion of said sheet between said first fold locating means and said sheet edges, said pair of first edge tabs extending from said first end to a pair of first fold locating means;

a pair of second edge tabs defined by that portion of said sheet between said pair of first fold locating means and said sheet edges, and between said pair of second fold locating means and a pair of third locating means;

a pair of third edge tabs defined by that portion of said sheet between said pair of first fold locating means and said sheet edges, and between said pair of third fold locating means and said second end;

b) folding said pair of third edge tabs about said pair of third fold locating means, such that said first faces of said third edge tabs face said first faces of said second edge tabs;

c) folding said folded pair of third fourth edge tabs and said pair of second edge tabs about said pair of second fold locating means such that said second faces of said third edge tabs and said first faces of said second edge tabs are facing said first faces of said second edge tabs;

d) folding said folded pair of third edge tabs and said pair of first edge tabs about said pair of first fold locating means, such that said second faces of said second edge tabs are facing said first face of said center portion.

24. The method as recited in claim 23, wherein said first faces of said third edge tabs are attached to said first faces of said second edge tabs, said second faces of said second edge tabs and said first faces of said second edge tabs are attached to said first faces of said second edge tabs, and said second faces of said second edge tabs are attached to said first face of said center portion.

25. The method as recited in claim 24, wherein said first faces of said third edge tabs are attached to said first faces of said second edge tabs, and said second faces of said third edge tabs and said first faces of said second edge tabs are attached to said first faces of said first edge tabs, by a pair of adhesive lines running essentially parallel with said second fold locating means approximately at the center of said second, second and fourth edge tabs, said second faces of said third edge tabs are attached to said first face of said center portion by a pair of adhesive lines running essentially parallel with the centerline approximately one-half the distance between the centerline and said first locating means.

26. The method as recited in claim 23, wherein said sheet has a pair of notches extending from said second end along said pair of first fold locating means.

27. The method as recited in claim 23, wherein said sheet has a pair of slits extending from said second end along said pair of first fold locating means, said slits separate said second edge tabs and said third edge tabs from said center portion.

28. An asphalt composition ridge cover having a centerline, comprising:

an essentially rectangular sheet having a first end, a second end, a pair of edges, a first face and a second face each said end and said edge extending along a straight line such that said edges and said ends define a parallelogram;

a pair of fold locating means in said sheet that define a center portion, said first fold locating means extending essentially parallel to the centerline;

a pair of first edge tabs defined by that portion of said sheet between said first fold locating means and said sheet edges, said pair of first edge tabs extending from said first end to a pair of second fold locating means;

a pair of second edge tabs defined by that portion of said sheet between said pair of first fold locating means and said sheet edges, and between a pair of third fold locating means and said pair of second fold locating means;

a pair of third edge tabs defined by that portion of said sheet between said pair of first fold locating means and said sheet edges, and between said pair of third fold locating means and said second end;

a pair of first lines of adhesive extending along said second, third and fourth edge tabs essentially parallel with the centerline;

a pair of second lines of adhesive extending along said center portion essentially parallel with the center portion;

a pair of notches extending from said second end along said pair of first fold locating means; and a pair of slits extending from said second end along said pair of first fold locating means, said slits separate said second edge tabs and said third edge tabs from said center portion.

29. A method of forming an asphalt composition ridge cover having a centerline, comprising the steps of:

a) providing:

an essentially rectangular sheet having a first end, a second end, a pair of edges, a first face and a second face each said end and said edge extending along a straight line such that said edges and said ends define a parallelogram;

a pair of first fold locating means in said sheet that define a center portion, said first fold locating means extending essentially parallel to the centerline;

a pair of first edge tabs defined by that portion of said sheet between said first fold locating means and said sheet edges, said pair of first edge tabs extending from said first end to a pair of second fold locating means;

a pair of first edge tabs defined by that portion of said sheet between said pair of second fold locating means and said sheet edges, and between a pair of fourth fold locating means and said pair of third fold locating means;

a pair of third fourth edge tabs defined by that portion of said sheet between said pair of first fold locating means and said sheet edges, and between said pair of third fold locating means and said second end;

a pair of notches extending from said second end along said pair of first fold locating means;

a pair of slits extending from said first end along said pair of second fold locating means, said slits separate said second edge tabs and said third edge tabs from said center portion;

b) folding said pair of third edge tabs about said pair of third fold locating means, such that said first faces of said third edge tabs face said first faces of said edge tabs;

c) folding said folded pair of third edge tabs and said pair of second edge tabs about said pair of second fold locating means such that said second faces of said third edge tabs and said first faces of said second edge tabs are facing said first faces of said first edge tabs, said first faces of said third edge tabs are attached to said first faces of said second edge tabs, and said second faces of said third edge tabs and said first faces of said second edge tabs are attached to said first faces of said first edge tabs, by a pair of adhesive lines running essentially parallel with said first fold locating means approximately at the center of said second, third and fourth edge tabs;

d) folding said folded pair of second edge tabs and said pair of first edge tabs about said pair of first fold locating means, such that said second faces of said second edge tabs are facing said first face of said center portion, said second faces of said first edge tabs are attached to said first face of said center portion by a pair of adhesive lines running essentially parallel with the centerline approximately one-half the distance between the centerline and said first locating means.

* * * * *

UNITED STATES PATENT AND TRADEMARK OFFICE

CERTIFICATE OF CORRECTION

PATENT NO. : 5,319,898

DATED : June 14, 1994

INVENTOR(S) : Freiborg

It is certified that error appears in the above-identified patent and that said Letters Patent is hereby corrected as shown below:

In column 11 at line 22 change"said edge tabs;" to --said second edge tabs;--.

Signed and Sealed this

Twentieth Day of June, 1995

Bruce Lehman

*Attest:*

BRUCE LEHMAN

*Attesting Officer*

*Commissioner of Patents and Trademarks*